US009394662B2

(12) United States Patent
Younan

(10) Patent No.: US 9,394,662 B2
(45) Date of Patent: Jul. 19, 2016

(54) SUCTION CAISSON WITH WEAKENED SECTION AND METHOD FOR INSTALLING THE SAME

(71) Applicant: Adel H. Younan, Sugar Land, TX (US)

(72) Inventor: Adel H. Younan, Sugar Land, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 0 days.

(21) Appl. No.: 14/435,400

(22) PCT Filed: Nov. 13, 2013

(86) PCT No.: PCT/US2013/069930
§ 371 (c)(1),
(2) Date: Apr. 13, 2015

(87) PCT Pub. No.: WO2014/088770
PCT Pub. Date: Jun. 12, 2014

(65) Prior Publication Data

US 2015/0299974 A1 Oct. 22, 2015

Related U.S. Application Data

(60) Provisional application No. 61/734,813, filed on Dec. 7, 2012.

(51) Int. Cl.
*E02B 17/00* (2006.01)
*E02D 23/00* (2006.01)
(Continued)

(52) U.S. Cl.
CPC ..... *E02B 17/0017* (2013.01); *E02D 23/00* (2013.01); *E02D 23/04* (2013.01); *E02D 23/08* (2013.01); *E21B 33/037* (2013.01)

(58) Field of Classification Search
CPC ..... E02B 17/0017
See application file for complete search history.

(56) References Cited

U.S. PATENT DOCUMENTS 3,817,040 A 6/1974 Stevens
3,866,676 A * 2/1975 Burns ..... E21B 33/037 166/363

(Continued)

FOREIGN PATENT DOCUMENTS

CA 2311256 A1 * 12/2000 ..... E02B 17/0021
EP 101649 11/1986

(Continued)

OTHER PUBLICATIONS

IMV Projects Atlantic, "Arctic Offshore Technology Assessment of Exploration and Production Options for Cold Regions of the US Outer Continental Shelf," technical report prepared for United States Department of the Interior Minerals Management Service, Jan. 31, 2008, pp. 245-247, figure 4-28, http://www.bsee.gov/uploadedFiles/BSEE/Technology_and_Research/Techonolgy_Assessment_Programs/Reports/500-599/584AA.pdf.

(Continued)

*Primary Examiner* — John Kreck
(74) *Attorney, Agent, or Firm* — ExxonMobil Upstream Research Company Law Dept.

(57) ABSTRACT

A suction caisson system comprising a caisson body comprising an upper rim, a lower rim, and a weakened section positioned between the upper rim and the lower rim. The system further comprises a caisson cover constructed and arranged to detachably connect to the upper rim of the caisson body as well as a pump constructed and arranged to provide fluid to and from the interior of the caisson body. In the event the caisson body is impacted by an advancing ice keel, or other foreign object, the caisson body will be sheared at the weakened cross-section, thus protecting any subsea equipment positioned within the caisson body below the weakened section.

19 Claims, 4 Drawing Sheets

(51) Int. Cl.

| | |
|---|---|
| ***E21B 33/037*** | (2006.01) |
| ***E02D 23/04*** | (2006.01) |
| ***E02D 23/08*** | (2006.01) |

(56) References Cited

U.S. PATENT DOCUMENTS

| | | | | |
|---|---|---|---|---|
| 4,080,797 | A | 3/1978 | Thompson | |
| 4,487,527 | A | 12/1984 | Kelly | |
| 4,558,744 | A * | 12/1985 | Gibb | E21B 33/037 166/222 |
| 4,808,037 | A | 2/1989 | Wade et al. | |
| 5,292,207 | A * | 3/1994 | Scott | E02B 17/0021 405/207 |
| 6,102,626 | A * | 8/2000 | Milberger | E21B 33/035 166/364 |
| 6,371,695 | B1 | 4/2002 | Davenport, III et al. | |

FOREIGN PATENT DOCUMENTS

| | | |
|---|---|---|
| EP | 0 997 330 | 5/2000 |
| GB | 282820 | 8/1928 |
| JP | 2000-130896 | 5/2000 |
| JP | 2000-274584 | 10/2000 |
| JP | 2011-189789 | 9/2011 |

OTHER PUBLICATIONS

Doha, Mazen, "Design Concept for a Subsea Wellhead Subject to Iceberg Contact for Marginal Field Development—Grand Banks of Newfoundland," thesis submitted to the School of Graduate Studies, Faculty of Engineering and Applied Science, Memorial University of Newfoundland, May 2007, St. John's, Newfoundland, Canada.

* cited by examiner

SUCTION CAISSON WITH WEAKENED SECTION AND METHOD FOR INSTALLING THE SAME

CROSS-REFERENCE TO RELATED APPLICATION

This application is the National Stage of International Application No. PCT/US2013/069930, filed 13 Nov. 2013, which claims the priority benefit of U.S. Provisional Patent Application 61/734,813 filed 7 Dec. 2012 entitled SUCTION CAISSON WITH WEAKENED SECTION AND METHOD FOR INSTALLING THE SAME, the entirety of which is incorporated by reference herein.

FIELD OF INVENTION

This invention generally relates to the field of suction caissons and, more particularly, to a suction caisson designed to protect subsea equipment.

BACKGROUND

This section is intended to introduce various aspects of the art, which may be associated with some embodiments of the present invention. This discussion is believed to assist in providing a framework to facilitate a better understanding of particular aspects of the present invention. Accordingly, it should be understood that this section should be read in this light, and not necessarily as admissions of prior art.

Subsea hydrocarbon equipment located in shallow water artic regions typically risk being damaged by sea-ice gouging keels or icebergs. As a result, subsea trees, wellheads, and pipelines, to name a few examples, must be protected from such forces. While the environmental risk of shearing a pipeline is limited to its hydrocarbon inventory, the potential risk of shearing a wellhead is the entire reservoir capacity.

A variety of techniques exist for addressing the risks associated with shallow water arctic conditions. One technique, often referred to in the industry as a "glory hole", is to simply dig a hole deep enough to avoid the wrath of the gouging keel. This technique requires the removal or evacuation of a substantial portion of the seabed and is often costly both in terms of financial costs but also in its environmental impact. Another technique relies on the use of protective structures to surround a wellhead. Many of the proposed concepts in literature are based on building a subsea fortress using either rock, a man-made shielding structure either resting on the seafloor or piled to it, and/or a combination of both. While some of these concepts may eliminate environmental impact, these complex systems may be cost prohibitive for exploration wells and/or minimum field tie-in wells. Others have proposed concepts which essentially combine glory holes and protective structures. Besides the high cost associated with installation, such concepts may have issues with the stability of the casing in face of an advancing ice keel.

Other concepts promote the utilization of sacrificial wellheads. These concepts permit the wellhead to be sheared by the advancing ice keel. A safety shutdown valve is installed below the perceived gouge depth in order to prevent the release of hydrocarbons. However, a significant disadvantage of these concepts is the risk of malfunction of the safety valve. In the event the safety valve fails, the entire reservoir may be released.

As noted above, the known techniques often involve time consuming and expensive steps prohibiting the development of minimal or marginal fields. Some of the known techniques either cause significant environmental damage due to the excavation of large amounts of seabed soil or pose significant environmental risk in their design. Thus, there is a need for improvement in this field.

SUMMARY OF THE INVENTION

The present disclosure provides a suction caisson with a weakened section in order to protect subsea hydrocarbon equipment and a method of installing the same.

One embodiment of the present disclosure is a suction caisson system comprising a caisson body comprising an upper rim, a lower rim, and a weakened section positioned between the upper rim and the lower rim. The system further comprises a caisson cover constructed and arranged to detachably connect to the upper rim of the caisson body as well as a pump constructed and arranged to provide fluid to and from the interior of the caisson body.

The foregoing has broadly outlined the features of one embodiment of the present disclosure in order that the detailed description that follows may be better understood. Additional features and embodiments will also be described herein.

BRIEF DESCRIPTION OF THE DRAWINGS

The present invention and its advantages will be better understood by referring to the following detailed description and the attached drawings.

Figure 1:
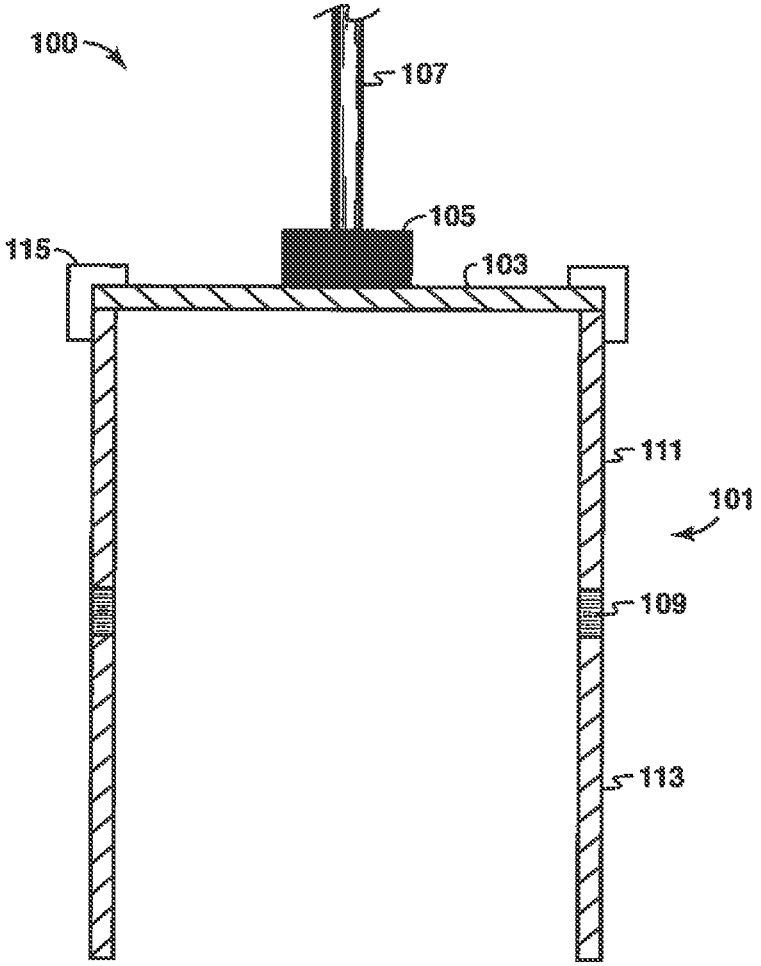
FIG. 1 is a side, cross-sectional view of a suction caisson system according to one embodiment of the present disclosure.

It should be noted that the figures are merely examples of several embodiments of the present invention and no limitations on the scope of the present invention are intended thereby. Further, the figures are generally not drawn to scale, but are drafted for purposes of convenience and clarity in illustrating various aspects of certain embodiments of the invention.

DESCRIPTION OF THE SELECTED EMBODIMENTS

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

Persons skilled in the technical field will readily recognize that in practical applications of the disclosed methodology, some of the steps may be performed on a computer, typically a suitably programmed digital computer. Further, some portions of the detailed descriptions which follow are presented in terms of procedures, steps, logic blocks, processing and other symbolic representations of operations on data bits within non-transitory computer memory. These descriptions and representations are the means used by those skilled in the data processing arts to most effectively convey the substance of their work to others skilled in the art. In the present application, a procedure, step, logic block, process, or the like, is conceived to be a self-consistent sequence of steps or instructions leading to a desired result. The steps are those requiring physical manipulations of physical quantities. Usually, although not necessarily, these quantities take the form of electrical or magnetic signals capable of being stored, transferred, combined, compared, and otherwise manipulated in a computer system.

It should be borne in mind, however, that all of these and similar terms are to be associated with the appropriate physical quantities and are merely convenient labels applied to these quantities. Unless specifically stated otherwise as apparent from the following discussions, it is appreciated that throughout the present application, discussions utilizing the terms such as "processing", "computing", "calculating", "determining", "displaying", "producing", "storing", "identifying", "implementing", "generating" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

One embodiment of the present disclosure is a suction caisson system having a caisson body with a removable top and an engineered weak cross-section (pre- or post-installation). The engineered weak cross-section may be positioned at a depth below an expected gouge depth caused by the keel of a drifting ice floe or iceberg. In some embodiments, the caisson body is large enough to permit the drilling of a well inside the caisson body and to allow inspection/maintenance of its wellhead. In some embodiments, the caisson body is also driven into the seabed deep enough to allow the wellhead to be safely positioned below the gouge depth. Further, the weakened section of the caisson body allows the caisson to be sheared by a gouging ice keel. In some embodiments, upon installation of the caisson, the top is removed and the subsea soil is excavated from within the caisson body to a target depth providing a wellhead top clearance below the gouge depth. Wellbore drilling may then follow with the wellhead eventually being placed on top of an installed top casing. In the event the caisson body is impacted by an advancing ice keel, the caisson will be sheared at the weakened cross-section, but the ice keel will not impact the wellhead and the well is thus saved.

FIG. 1 is a side, cross-sectional view of a suction caisson system 100 according to one embodiment of the present disclosure. As depicted, suction caisson system 100 includes a caisson body 101 and a detachable cover 103. In order to generate the differential pressure required to install or remove the suction caisson body 101 into or from the seabed soil, a pump 105 is positioned adjacent to cover 103. Pump 105 is constructed and arranged to pump fluid either into or from the area interior to the caisson body 101. Though not depicted, cover 103 has at least one opening or aperture which allows pump 105 to deliver fluid (such as, but not limited to, water) to and from the interior of caisson body 101. Pump 105 may be controlled through a variety of known techniques. In the depicted embodiment, a control umbilical 107 is provided to operate and control pump 105. In other non-limited embodiments, pump 105 may be operated by a remotely operated vehicle or through a wireless control system.

As depicted in FIG. 1, caisson body 101 comprises a weakened section 109 which defines an upper body portion 111 located above the weakened section 109 and a lower body portion 113 located below the weakened section 109. Said differently, the weakened section 109 is positioned along the length of the caisson body 101 between the body's upper and lower rim. The weakened section 109 is the point of separation between upper body portion 111 and lower body portion 113 in the event the caisson body 101 is impacted by a large foreign object, such as, but not limited to, an iceberg.

As used herein, the weakened section is a portion of the caisson body which has a lower shearing force than the remainder of the caisson body. The weakened section may be applied to a caisson body through a variety of techniques which will be appreciated by those skilled in the art. For example, the weakened section may have a smaller cross-section than the other portions of the caisson body. In another embodiment, holes may be drilled or otherwise provided in the caisson body in order to define the weakened section. In yet another embodiment, the weakened section may be comprised of a different material than the remainder of the caisson body.

In some embodiments, the weakened section is provided in the caisson body pre-installation into the seabed. In other embodiments, the weakened section is created after the caisson body is installed. In some embodiments, the weakened section is provided around the entire perimeter of the caisson body. In other embodiments, the weakened section is provided around less than the entire perimeter of the caisson body. Typically, the caisson body 101 has a circular cross-section, though other geometries may be appropriate. Though only one weakened section is provided in the FIG. 1 embodiment, the caisson body of other embodiments may have multiple weakened sections provided along the length of the caisson body to allow for different shear points at different depths.

Returning to FIG. 1, cover 103 is detachable from the caisson body 101. In the depicted embodiment, attachment device 115 physically holds cover 103 to the upper rim of upper body portion 111. The attachment device 115 may be any known device or mechanism. The attachment device may be positioned either exterior or interior to the caisson body. Any number of attachment devices may be utilized based on application. Though not depicted, gaskets and/or seals may be provided at the interface between the cover 103 and the rim of upper body portion 111.

Figure 2:
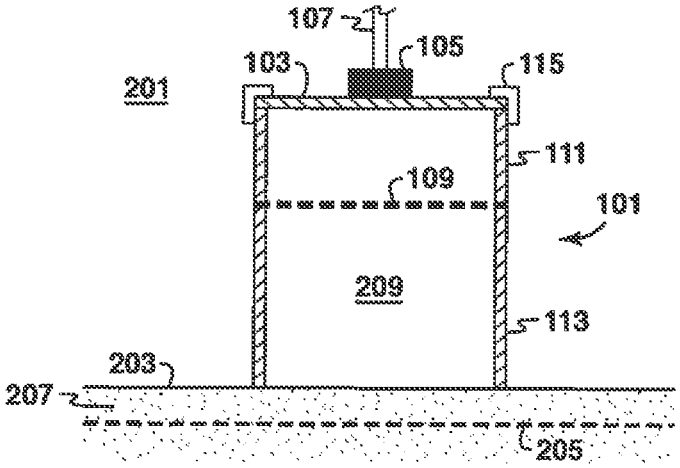
FIG. 2 is a side view of a suction caisson system positioned on the seafloor according to one embodiment of the present disclosure.

FIG. 2 is a side view of a suction caisson system 100 is positioned on the seafloor 203 according to one embodiment of the present disclosure. As appreciated by those skilled in the art, the suction caisson system 101 has been placed into a body of water 201 using known techniques. The caisson body 101 is then lowered into place were a potential well is to be drilled. At this potential well location, a gouge depth 205 has been determined using known techniques. As appreciated by those skilled in the art, the gouge depth 205 is the estimated depth of sea-ice gouges into the subsea soil 207.

When the caisson body 101 is lowered onto the seafloor 203, the rim of the lower portion 113 of the caisson body 101 will cut into the seabed soil 207, thereby creating a seal between the caisson and the seafloor. However, the weight of the caisson body itself is insufficient to completely drive the caisson into the seabed soil 207.

Figure 3:
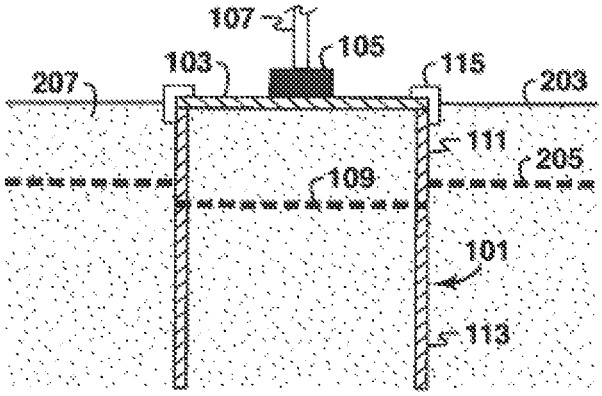
FIG. 3 is a side view of a suction caisson system after the suction caisson has been embedded into the seafloor according to one embodiment of the present disclosure.

In order to install the suction caisson, a suction force is then applied by pumping out the water enclosed within the caisson cavity 209. The differential pressure between the top of the caisson and within cavity 209 drives the caisson body 101 into the seabed soil 207. FIG. 3 is a side view of suction caisson system 100 after the suction caisson body 101 has been embedded into the seabed soil 207 according to one embodiment of the present disclosure. In the depicted embodiment, the weakened section 109 of the caisson body is positioned below the estimated gouge depth 205. In other embodiments, the weakened section 109 may be substantially level with the estimated ice gouge depth 205.

Figure 4:
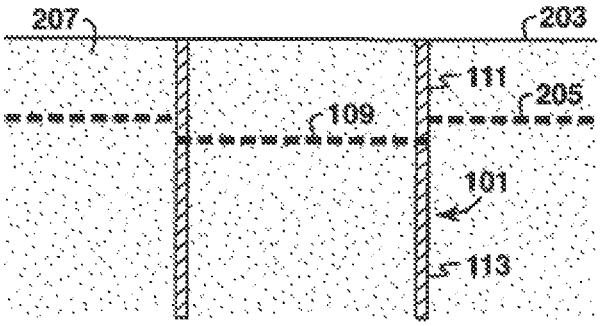
FIG. 4 is a side view of the suction caisson depicted in FIG. 3 after the top cover and suction equipment have been removed according to one embodiment of the present disclosure.

Once the caisson body 101 has been successfully installed and the weakened section 109 is positioned at the appropriate depth, the attachment devices 115 may be released and the top cover 103 removed. FIG. 4 is a side view of the suction caisson in which the top cover 103 and the associated control equipment (pump 105 and control umbilical 107) have been removed. In order to install a wellhead below the gouge depth 205, the soil 207 inside the caisson body 101 is excavated. The top cover 103 is removed in order to provide access to soil 207 inside the caisson body 101. The soil may be excavated using techniques known by those skilled in the art.

Figure 5:
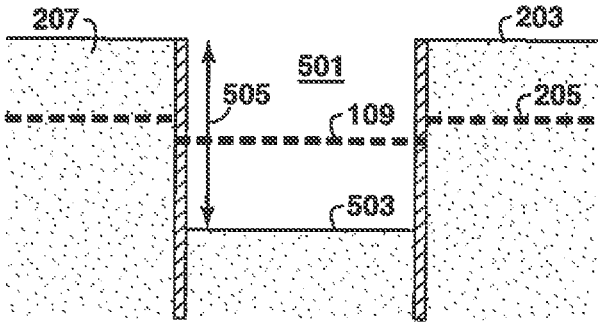
FIG. 5 is a side view of an installed suction caisson in which soil has been excavated from inside the caisson according to one embodiment of the present disclosure.

FIG. 5 is a side view of the suction caisson in which a portion of the soil within the caisson body 101 has been removed. As depicted, the excavated area defines a caisson cavity 501 which is filled with water. The soil 207 is excavated until the cavity floor 503 reaches a target depth 505. In the depicted embodiment, target depth 505 is the distance between the seafloor 203 and cavity floor 503. In one embodiment, the target depth 505 is the sum of the gouge depth 205, wellhead height and a predetermined amount of clearance. The clearance provides a buffer between the top of the wellhead and the gouge depth.

Figure 6:
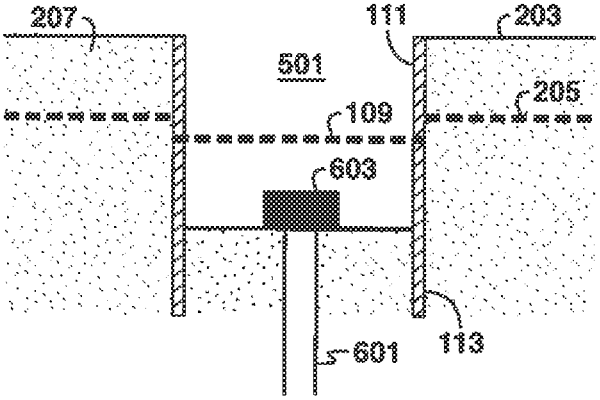
FIG. 6 is a side view of an installed suction caisson in which the wellbore has been drilled and the well head has been installed.

Once the soil within the caisson body 101 has been excavated and the target depth 505 is reached, drilling operations may begin as known by those skilled in the art. FIG. 6 is a side view of a suction caisson according to one embodiment of the present disclosure after the drilling and wellhead assembly operations have been completed. As depicted, the wellbore 601 has been drilled and the wellhead 603 has been installed within the caisson cavity 501. In the FIG. 6 embodiments, the top of the wellhead 603 is positioned below the ice gouge depth 205 as well as weakened section 109.

Figure 7:
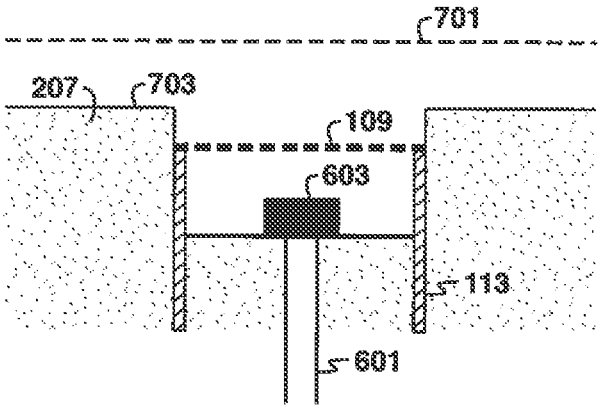
FIG. 7 is a side view of the suction caisson and wellhead depicted in FIG. 6 after ice has scoured the adjacent soil according to one embodiment of the present disclosure.

FIG. 7 is a side view of the suction caisson and wellhead depicted in FIG. 6 after an iceberg hit according to one embodiment of the present disclosure. The original seafloor depth is depicted by dashed line 701. Due to the scouring done by the ice keel, the gouged seafloor level 703 is lower than original seafloor level 701. As depicted, the caisson body 101 has been sheared at weakened section 109. Therefore, lower portion 113 of the caisson body 101 remains and continues to provide protection to wellbore 601 and wellhead 603. In the depicted embodiment, the wellhead 603 is protected by sacrificing a section of the caisson body 101.

Figure 8:
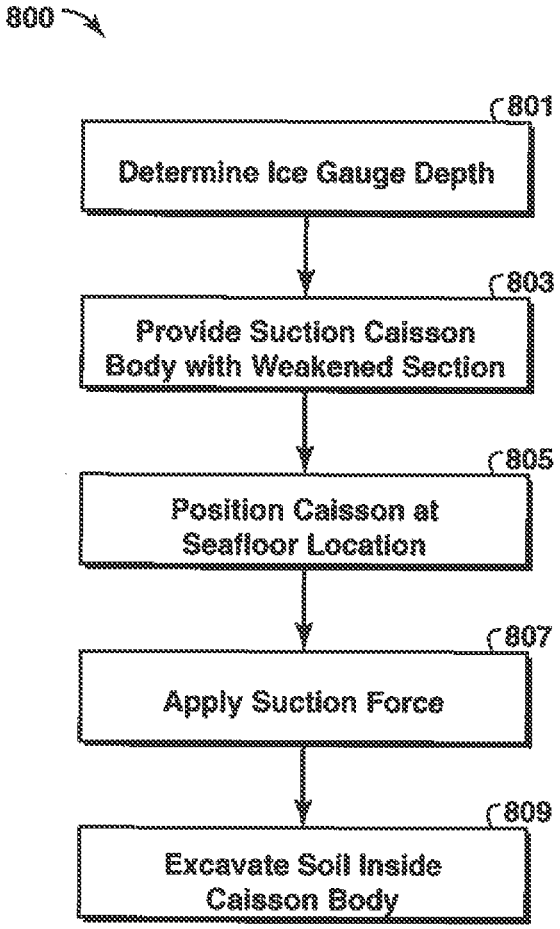
FIG. 8 is a flowchart depicting the basic steps of installing a suction caisson according to one embodiment of the present disclosure.

FIG. 8 is a flow chart depicting the basic steps of installing a suction caisson according to one embodiment of the present disclosure. Process 800 begins by determining the ice gouge depth for a given location (step 801). Next, a suction caisson system comprising a caisson body is provided (step 803). In one embodiment, the caisson body has a weakened section. In another embodiment, the weakened section is provided after it has been installed into the seabed. The position of the weakened section along the length of the caisson body is based on the determined ice gouge depth.

At step 805, the caisson is positioned at the well location. As discussed herein, the weight of the caisson body is sufficient to partially embed the lower rim of the caisson body into the seabed, but is insufficient to completely install the caisson. Therefore, at step 807, a suction force is applied using known suction caisson techniques to install the caisson into the seabed. In some embodiments, installation is completed once the weakened section has been positioned at the appropriate depth. In other embodiments, a weakened section can be created following installation of the caisson body. In such an embodiment, the weakened section is provided at the appropriate depth, such as, but not limited to, below the estimated gouge depth.

At step 809, the soil inside the caisson body is excavated to a target depth. The soil is excavated by detaching and removing the top cover from the caisson body. As discussed above, the target depth may depend on application and design objectives. In some embodiments, the target depth is equal to the sum of the determined ice gouge, the wellhead height, and a clearance space. Once the soil within the caisson has been excavated to the necessary depth, drilling may be started according to techniques known by those skilled in the art.

It is important to note that the steps depicted in FIG. 8 are provided for illustrative purposes only and a particular step may not be required to perform the inventive methodology. The claims, and only the claims, define the inventive system and methodology. In some embodiments, the seafloor may be scanned for objects which would obstruct the installation of the suction caisson, such as large boulders.

The embodiments presented herein provide several advantages over prior art designs. By providing a defined weakened section within the caisson body, the shear point of the caisson body may be predetermined thereby limiting damage to subsea well components. Further, in the event shearing occurs, a portion of the caisson body remains thereby providing further protection to the subsea well components. By utilizing a section caisson design, the cost, installation time, and environmental impact of the disclosed protection system are managed which allow for it to be feasible for multiple applications, such as, but not limited to, exploration wells and the development of minimum tie-in fields.

Embodiments of the present disclosure have primarily focused on the protection of wellheads. However, the suction caissons described herein may be used to protect any type of subsea equipment, such as, but not limited to, Christmas trees, leak detection equipment, subsea template, manifold assembly, etc. In such embodiments, the target depth of the caisson cavity would be based on the height of the subsea equipment.

As understood by those skilled in the art, suction caissons are also sometimes referred to as buckets, skirted foundations or suction anchors. The caisson body may be constructed of a variety of known materials, such as, but not limited to, steel or concrete. The diameter of the caisson body is dictated by engineering design. In some embodiments, the caisson body may have a diameter up to 10 meters. In other embodiments, the diameter may be larger. The length of the caisson body is also dictated by engineering design. In some embodiments, the caisson body may have a length up to 30 meters, though other lengths may be utilized. As appreciated by those skilled in the art, the caisson body may be equipped with internal reinforcements to prevent buckling.

The following lettered paragraphs represent non-exclusive ways of describing embodiments of the present disclosure.

A. A method for installing a subsea equipment protection system into a seabed soil comprising: determining an ice gouge depth at a seafloor location; providing a suction caisson system comprising a caisson body, a detachable cover and a pump constructed and arranged to deliver fluid to and from the interior of the caisson body; positioning the caisson body at the seafloor location; operating the pump to apply a suction force thereby embedding the caisson body into the seabed soil; removing the detachable cover; and excavating a portion of the seabed soil located inside the caisson body, wherein the caisson body has a weakened section located between an upper end and a lower end of the caisson body.

A1. The method of paragraph A, wherein the seabed soil is evacuated from the suction caisson until a target depth is reached.

A2. The method of paragraph A1, wherein the target depth is equal to the gouge depth plus a subsea equipment height.

A3. The method of paragraph A1, wherein the target depth is greater than the gouge depth plus a subsea equipment height.

A4. The method of any preceding paragraph, wherein the weakened section of the installed suction caisson is positioned below the ice gouge depth.

A5. The method of any preceding paragraph further comprising drilling and stalling a wellhead.

A6. The method of paragraph A5, wherein the installed wellhead is positioned below the weakened section.

A7. The method of any preceding paragraph, wherein the weakened section is fabricated after the caisson is installed into the seabed soil.

A8. The method of any preceding paragraph, wherein the weakened section is provided around the entire perimeter of the caisson body.

A9. The method of any preceding paragraph, wherein the weakened section is fabricated by drilling a plurality of holes into the caisson body.

A10. The method of any preceding paragraph, wherein the caisson body has a plurality of weakened sections provided along the length of the caisson body.

B. A suction caisson system comprising: a caisson body comprising an upper rim, a lower rim, and a weakened section positioned between the upper rim and the lower rim; a caisson cover constructed and arranged to detachably connect to the upper rim of the caisson body; and a pump constructed and arranged to provide fluid to and from the interior of the caisson body.

B1. The suction caisson system of paragraph B, wherein the caisson body has a plurality of weakened sections provided along the length of the caisson body.

B2. The suction caisson system of any preceding paragraph, wherein the weakened section is provided around the entire perimeter of the caisson body.

B3. The suction caisson system of any preceding paragraph, wherein the weakened section is defined by a plurality of holes provided in the caisson body.

B4. The suction caisson system of any preceding paragraph, wherein the weakened section is composed of a first material, a remainder of the caisson body is composed of a second material, the first material is different from the second material.

B5. The suction caisson of any preceding paragraph, wherein the weakened section has a first cross-sectional dimension, the caisson body proximate to the upper rim has a second cross-sectional dimension, the first cross-sectional dimension is less than the second cross-sectional dimension.

It should be understood that the preceding is merely a detailed description of specific embodiments of this invention and that numerous changes, modifications, and alternatives to the disclosed embodiments can be made in accordance with the disclosure here without departing from the scope of the invention. The preceding description, therefore, is not meant to limit the scope of the invention. Rather, the scope of the invention is to be determined only by the appended claims and their equivalents. It is also contemplated that structures and features embodied in the present examples can be altered, rearranged, substituted, deleted, duplicated, combined, or added to each other. The articles "the", "a" and "an" are not necessarily limited to mean only one, but rather are inclusive and open ended so as to include, optionally, multiple such elements.

What is claimed is:

1. A method for installing a subsea equipment protection system into a seabed soil comprising:

determining an ice gouge depth at a seafloor location;

providing a suction caisson system comprising a caisson body, a detachable cover and a pump constructed and arranged to deliver fluid to and from the interior of the caisson body;

positioning the caisson body at the seafloor location;

operating the pump to apply a suction force thereby embedding the caisson body into the seabed soil;

removing the detachable cover;

excavating a portion of the seabed soil located inside the caisson body; and installing subsea equipment inside the caisson body, wherein the caisson body has a weakened section located between an upper end and a lower end of the caisson body, the weakened section having a first cross-sectional dimension, the caisson body having a second cross-sectional dimension proximate the upper rim, and the first cross-sectional dimension is less than the second cross-sectional dimension, and wherein the top of the subsea equipment is positioned below the weakened section.

2. The method of claim 1, wherein the seabed soil is evacuated from the suction caisson until a target depth is reached.

3. The method of claim 2, wherein the target depth is equal to the gouge depth plus a subsea equipment height.

4. The method of claim 2, wherein the target depth is greater than the gouge depth plus a subsea equipment height.

5. The method of claim 1, wherein the subsea equipment includes a wellhead.

6. The method of claim 1, wherein the weakened section is fabricated after the caisson is installed into the seabed soil.

7. The method of claim 6, wherein the weakened section is provided around the entire perimeter of the caisson body.

8. The method of claim 1, wherein the caisson body has a plurality of weakened sections provided along the length of the caisson body.

9. A suction caisson system comprising:

a caisson body comprising an upper rim, a lower rim, and a weakened section positioned between the upper rim and the lower rim, the weakened section having a first cross-sectional dimension, the caisson body having a second cross-sectional dimension proximate the upper rim, and the first cross-sectional dimension is less than the second cross-sectional dimension;

a caisson cover constructed and arranged to detachably connect to the upper rim of the caisson body;

a pump constructed and arranged to provide fluid to and from the interior of the caisson body; and subsea equipment arranged inside the caisson body, wherein the top of the subsea equipment is positioned below the weakened section.

10. The suction caisson system of claim 9, wherein the caisson body has a plurality of weakened sections provided along the length of the caisson body.

11. The suction caisson system of claim 9, wherein the weakened section is provided around the entire perimeter of the caisson body.

12. The suction caisson system of claim 9, wherein the weakened section is defined by a plurality of holes provided in the caisson body.

13. The suction caisson system of claim 9, wherein the weakened section is composed of a first material, a remainder of the caisson body is composed of a second material, the first material is different from the second material.

14. A method for installing a subsea equipment protection system into a seabed soil comprising:

determining an ice gouge depth at a seafloor location;

providing a suction caisson system comprising a caisson body, a detachable cover and a pump constructed and arranged to deliver fluid to and from the interior of the caisson body;

positioning the caisson body at the seafloor location;

operating the pump to apply a suction force thereby embedding the caisson body into the seabed soil;

removing the detachable cover;

excavating a portion of the seabed soil located inside the caisson body;

fabricating a weakened section in the caisson body between an upper end and a lower end of the caisson body after embedding the caisson body; and installing subsea equipment inside the caisson body, wherein the top of the subsea equipment is positioned below the weakened section.

15. The method of claim 14, wherein the weakened section is provided around the entire perimeter of the caisson body.

16. The method of claim 15, wherein the weakened section is fabricated by drilling a plurality of holes into the caisson body.

17. The method of claim 14, wherein the caisson body has a plurality of weakened sections provided along the length of the caisson body.

18. The method of claim 14, wherein the weakened section is positioned at or below the ice gouge depth.

19. A method for installing a subsea equipment protection system into a seabed soil comprising:

determining an ice gouge depth at a seafloor location;

providing a suction caisson system comprising a caisson body, a detachable cover and a pump constructed and arranged to deliver fluid to and from the interior of the caisson body;

positioning the caisson body at the seafloor location;

operating the pump to apply a suction force thereby embedding the caisson body into the seabed soil;

removing the detachable cover;

excavating a portion of the seabed soil located inside the caisson body; and installing subsea equipment inside the caisson body, wherein the caisson body has a weakened section located between an upper end and a lower end of the caisson body, the weakened section is composed of a first material, the remainder of the caisson body is composed of a second material, and the first material is different from the second material, and wherein the top of the subsea equipment is positioned below the weakened section.

* * * * *